US006062109A

United States Patent [19]

Mühlebach et al.

[11] Patent Number: 6,062,109

[45] Date of Patent: May 16, 2000

[54] PRESSURE JAW FOR COMPRESSION DEVICE FOR INSTALLATION OF FLOATING FLOOR PANELS

[75] Inventors: Moritz Mühlebach, Wallisellen; Stephan Szabo, Greifensee, both of Switzerland

[73] Assignee: ProFloor Technology GmbH, Wallisellen, Switzerland

[21] Appl. No.: 09/007,176

[22] Filed: Jan. 14, 1998

[30] Foreign Application Priority Data

Feb. 12, 1997 [CH] Switzerland ..... 0307

[51] Int. Cl.[7] ..... E04F 15/00

[52] U.S. Cl. ..... 81/46

[58] Field of Search ..... 81/46, 3.41, 488

[56] References Cited

U.S. PATENT DOCUMENTS

| | | | |
|---|---|---|---|
| 2,884,035 | 4/1959 | Schut | 81/46 |
| 4,753,426 | 6/1988 | Varkala | 254/11 |
| 5,435,610 | 7/1995 | Roberts | 254/11 |
| 5,845,548 | 12/1998 | Nelson | 81/46 |

FOREIGN PATENT DOCUMENTS

| | | | |
|---|---|---|---|
| 406023677 | 2/1994 | Japan | 81/46 |

*Primary Examiner*—David A. Scherbel
*Assistant Examiner*—Lee Wilson
*Attorney, Agent, or Firm*—Watson Cole Grindle Watson, P.L.L.C.

[57] ABSTRACT

The pressure jaw (1) for a compression device to install floor elements in a diagonal manner relative to a rectangular floor area is generally triangular in shape, the longest side providing an edge part (2) bent downwardly to press against the outer edge of a floor element (4) whose outer edge is cut diagonally, preferably at an angle of 45°, in relation to the longest side of the floor element. On the two legs of equal length the pressure jaw includes edge strips (5) bent upwardly each of which serves to couple with a customary compression device that is designed to install floor panels parallel to the wall and which, for example, incorporates at the end of a compression belt (7) a similarly modified pressure jaw 6 which can be coupled with a pressure jaw (1) by the engaging of the edge strips (5). The floor panels 4 which are to be bonded at the tongue and groove can therefore be pressed together in a perpendicular direction in relation to the long- and narrow side cross joints (8, 9) between the floor panels by means of the compression force of a compression device.

9 Claims, 2 Drawing Sheets

PRESSURE JAW FOR COMPRESSION DEVICE FOR INSTALLATION OF FLOATING FLOOR PANELS

BACKGROUND OF THE INVENTION

1. Field of the Invention

The invention relates to a pressure jaw of a compression device for installing floating floor elements, like laminates and ready-made parquet, from several, strip-shaped floor elements which are installed parallel to each other and joined by means of a tongue and groove connections to form a flooring surface.

2. Prior Art

For floating floor elements which consist of laminates or ready-made parquet, there is no total adhesive bonding to the floor, but instead, as a rule, only bonding of the two meter long, strip-shaped floor elements at the tongue and groove and spring connection therebetween. If this adhesive bonding is not done very exactly in the first row of an entire room floor area, individual errors add to each other with intolerable installation results in the end, so that a clean bonding at the wall opposite from where the installation began cannot be achieved. Therefore, during installation of the first row a number of the same type compression devices are used with a separation between them and with whose help the element rows are pressed together with not too much and not too little pressure.

There are various compression devices for the performance of these tasks on the market, in which the compression force is exerted with mechanical parts according to the knuckle joint principle or with a compression ratchet using a compression belt. In each case there are pressure jaws located on both ends of such a compression device for placement against the narrow edge of the floor panels. With the available compression devices, however, only one row of floor panels can be pressed together during installation parallel to the wall.

SUMMARY OF THE INVENTION

This invention has the object of enabling installation of floor elements diagonally while using customary compression devices. During diagonal installation the floor elements must, however, be cut to size at an angle on the ends touching the room walls, i.e., at an angle deviating by under 90° from the long edges of the floor elements. As a rule this angle amounts to 45°, but occasionally another angle size may be desired. The compression force of the compression devices must always be exerted—beginning with the ends of the floor elements parallel to the room wall that were cut at an angle—in a perpendicular direction with regard to the long edges of all the floor elements that were pressed together. With pressure jaws of the usual type that is not possible. A special pressure jaw is therefore needed to solve the problem. According to this invention a pressure jaw includes a triangular plate with two equal legs having bent up edge strips on the two triangle sides of equal length that include a right angle which serve to couple with a pressure jaw, also bent upwardly, of a customary compression device that is used to install floor elements parallel to the wall.

Embodiments of the invention will be explained in the following reference being made to the accompanying drawings. They show:

DETAILED DESCRIPTION OF THE PREFERRED EMBODIMENTS

Figure 1:
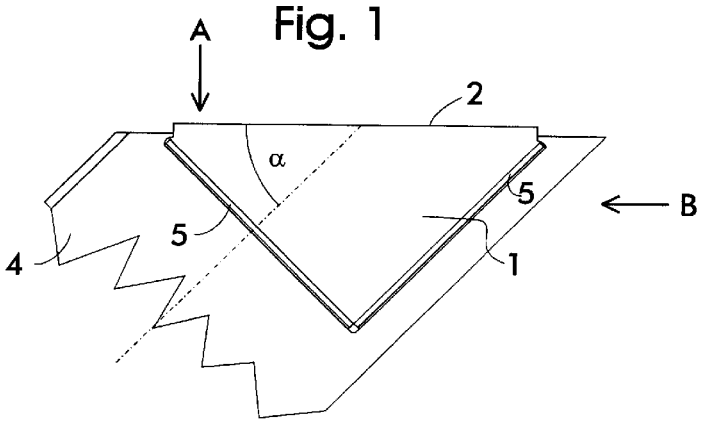
FIG. 1—is a top plan view of a pressure jaw in accordance with a preferred embodiment of the invention.
Figure 2:
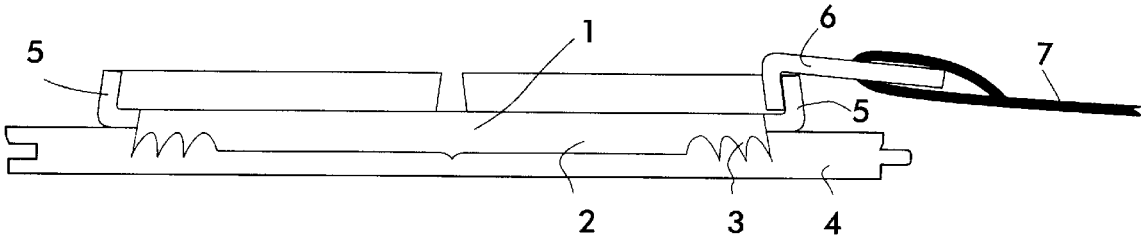
FIG. 2—is an enlarged side view of the pressure jaw, viewed in the direction of arrow A in FIG. 1.
Figure 3:
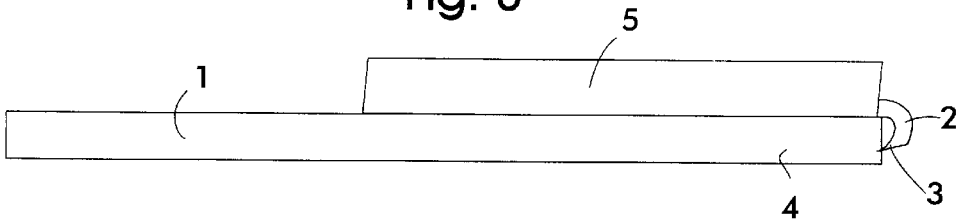
FIG. 3—is an enlarged side view of the pressure jaw, viewed in the direction of arrow B in FIG. 1.
Figure 4:
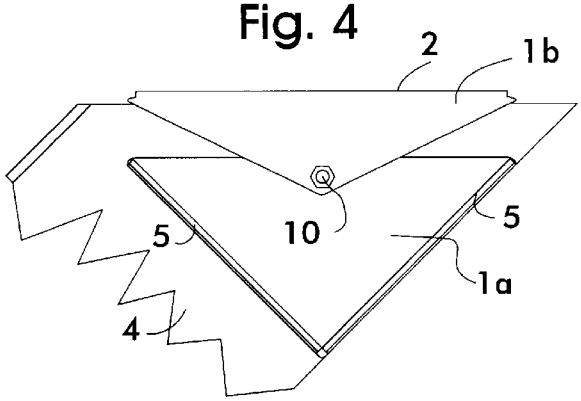
FIG. 4—is a top plan view of a modified, two part embodiment of the pressure jaw for the setting of any desired angle.

The pressure jaw according to FIG. 1 consists of a basically triangular-shaped plate 1 that includes on the long side an edge part 2 bent downwardly for placement against a floor element 4. The edge part 2 is provided with teeth 3 in sections which should penetrate into the material of the floor element shown in FIG. 1. The pressure jaw 1 also includes on the two triangle sides of equal length which include an angle of 90° edge strips 5 that are bent upwardly. These are bent by a little more than 90°, so that, as seen in FIG. 2, a pressure jaw 6 of a customary compression device that is bent in the same manner can couple with the pressure jaw 1 by simple overlapping of the edge strip 5, whereby the bend of more than 90° prevents the pressure jaws from slipping off each other. The compression force of the compression device then acts perpendicularly to an edge strip 5 and under an angle of 45° to the downwardly bent edge strip 2 which is equipped with teeth in order not to slip off the edge of the floor element cut at an angle with relation to the effect of the force of the compression device.

Customary compression devices for the installation of floor elements parallel to the wall, for example those with a compression belt 7, therefore can be used for diagonal installation in conjunction with the pressure jaw of FIG. 1.

Figure 5:
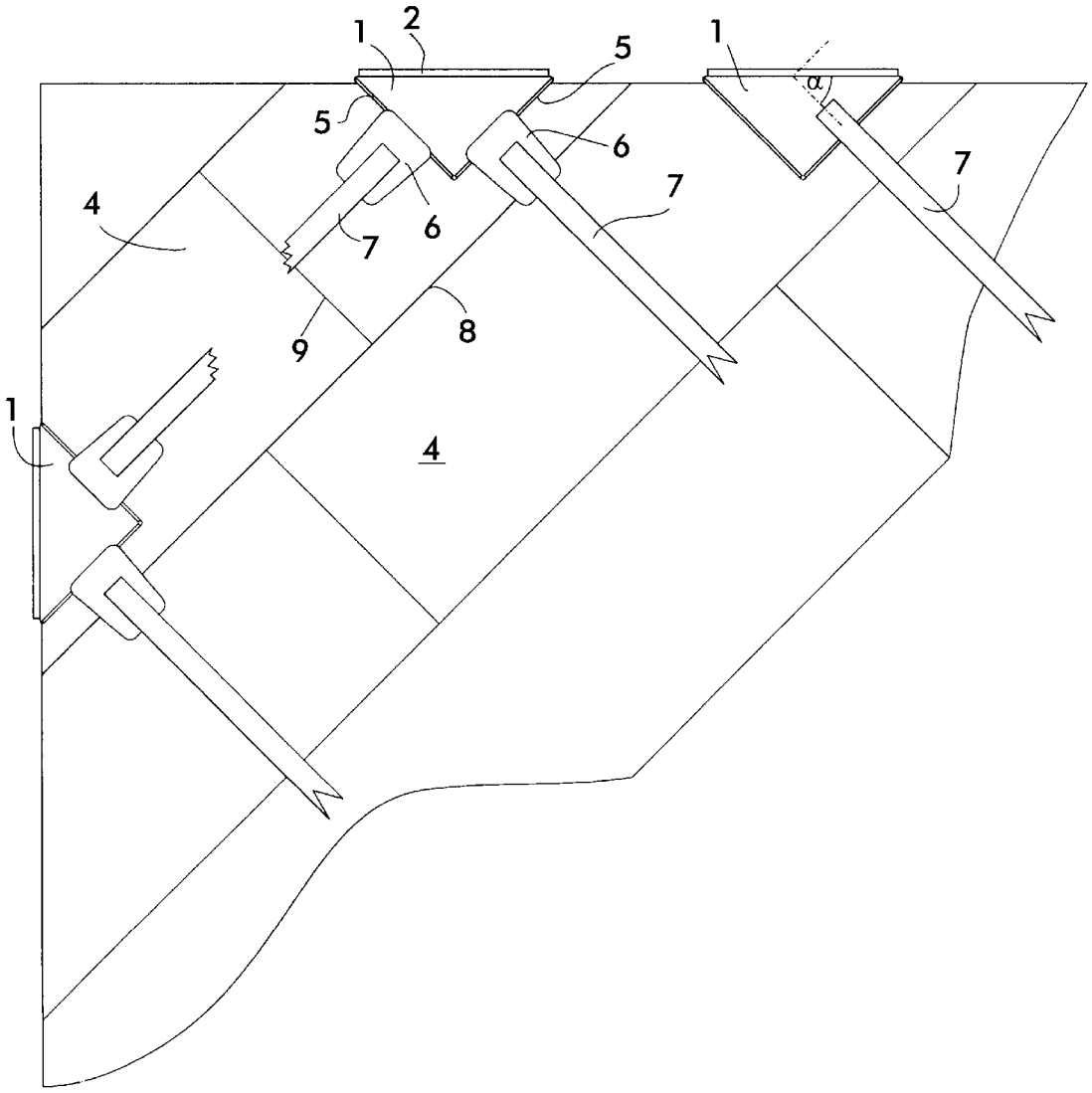
FIG. 5—is an overhead view of diagonal installation of floor panels in a room corner with the assistance of the invention pressure jaws.

According to FIG. 5 two compression devices can engage each other at a right angle at the both bent up edge strips 5 on a pressure jaw 1 in order to press together the connections consisting of a tongue and groove and requiring an adhesive on the long sides 8 as well as the narrow sides 9 of the floor elements 4. FIG. 5 depicts in an overhead view the diagonal installation in the area of a room corner against whose walls touch the floor elements cut at an angle with a slight space for the edge part 2 of the pressure jaw that has teeth. On the right side of FIG. 5 can also be seen, for example, that the belt 7 of a compression device can be attached directly to a pressure jaw 1.

Diagonal installation of floor elements occurs as a rule at an angle of 45°. For any desired angle deviating from that value another modified execution model of the pressure jaw as seen in FIG. 2 has been constructed in two parts and consists of a part 1*a* with edge strips 5 bent upwardly to couple with a compression device as well as a part 1*b* which manifests the bent edge part 2 designed to press against the outer edge of the floor element and which is equipped with teeth in sections. The parts are connected in the center by means of a screwed joint 10, so that they move relative to each other and can be locked by tightening the screwed joint in order to be able to set any desired angle between the edge part 2 and the tractive force direction of the compression device.

We claim:

1. A pressure jaw for use in connecting floating flooring elements in side-by-side relationship so as to form a flooring surface, said pressure jaw comprising a generally flat member defining a long side and two short sides, said member providing a flange along said long side that extends downwardly relative to an imaginary plane defined by said member so as to grip an end of a flooring element positioned therebelow, and edge strips extending upwardly relative to said plane along said two short sides and to which respective compression devices can be connected.

2. The pressure jaw according to claim 1, wherein said flange defines teeth for contacting said end of said flooring element.

3. The pressure jaw according to claim 1, wherein said edge strips extend upwardly from said member at an angle greater than 90°.

4. The pressure jaw according to claim 1, wherein said short sides extend at an angle of 45° with respect to said long side.

5. A pressure jaw according to claim 1, wherein said short sides extend at an angle of less than 45° with respect to said long side.

6. A pressure jaw according to claim 1, wherein said member is generally triangular in configuration.

7. A pressure jaw assembly for use in connecting floating flooring elements in side-by-side relationship to form a flooring surface, said pressure jaw assembly comprising a first generally flat member defining a long side and two short sides, said first member providing a flange along said long side that extends downwardly relative to a plane defined by said first member so as to grip a flooring element positioned therebelow, a second generally flat member defining a long side and two short sides, said second member providing edge strips extending upwardly relative to said plane along two short sides and to which connectors of separate compression devices can be connected, and connection means extending between said first and second members to allow rotational movement therebetween.

8. The pressure jaw assembly according to claim 7, wherein said connection means comprises a screw that extends through said first and second members.

9. The pressure jaw assembly according to claim 7, wherein said first and second members are each generally triangular in configuration.

* * * * *